US011714447B2

(12) United States Patent
Sicard

(10) Patent No.: US 11,714,447 B2
(45) Date of Patent: Aug. 1, 2023

(54) BANDGAP REFERENCE VOLTAGE CIRCUIT

(71) Applicant: NXP USA, Inc., Austin, TX (US)

(72) Inventor: Thierry Michel Alain Sicard, Auzeville tolosane (FR)

(73) Assignee: NXP USA, Inc., Austin, TX (US)

( * ) Notice: Subject to any disclaimer, the term of this patent is extended or adjusted under 35 U.S.C. 154(b) by 91 days.

(21) Appl. No.: 17/504,740

(22) Filed: Oct. 19, 2021

(65) Prior Publication Data

US 2022/0179441 A1 Jun. 9, 2022

(30) Foreign Application Priority Data

Dec. 3, 2020 (EP) ..... 20306484

(51) Int. Cl.
*G05F 3/30* (2006.01)
*G05F 1/46* (2006.01)

(52) U.S. Cl.
CPC . *G05F 3/30* (2013.01); *G05F 1/46* (2013.01)

(58) Field of Classification Search
CPC ... G05F 1/10; G05F 1/46; G05F 1/461; G05F 1/462; G05F 1/463; G05F 1/56; G05F 1/561; G05F 1/562; G05F 3/30; G05F 3/22; G05F 3/267
See application file for complete search history.

(56) References Cited

U.S. PATENT DOCUMENTS

| | | | | |
|---|---|---|---|---|
| 5,410,241 | A * | 4/1995 | Cecil | G05F 3/30 323/314 |
| 8,278,905 | B2 | 10/2012 | Harvey et al. | |
| 9,448,579 | B2 | 9/2016 | Marinca | |
| 10,404,054 | B2 * | 9/2019 | Huang | G05F 3/30 |
| 2002/0030536 | A1 * | 3/2002 | Chowdhury | G05F 3/30 327/539 |
| 2007/0296392 | A1 * | 12/2007 | Chen | G05F 3/30 323/313 |
| 2011/0068854 | A1 * | 3/2011 | Engl | G05F 3/30 327/512 |
| 2015/0015332 | A1 * | 1/2015 | Kronmueller | G05F 1/56 330/254 |
| 2020/0183434 | A1 * | 6/2020 | Hurwitz | G05F 3/30 |

FOREIGN PATENT DOCUMENTS

| | | |
|---|---|---|
| CN | 102081421 B | 6/2011 |
| CN | 104714588 B | 6/2015 |
| EP | 3712739 A1 | 9/2020 |

* cited by examiner

*Primary Examiner* — Thienvu V Tran
*Assistant Examiner* — Shahzeb K Ahmad

(57) ABSTRACT

The disclosure relates to a bandgap reference voltage circuit, in which an output reference voltage is stable with respect to temperature and other variations. Example embodiments include a bandgap reference voltage circuit comprising an output voltage circuit and a plurality, n, of offset amplifiers connected between first and second voltage rails, each of the plurality of offset amplifiers comprising a differential pair of transistors that together define an offset between an input voltage at an input and an output of the amplifier, the offset amplifiers being chained together and connected to the output voltage circuit that provides a bandgap reference voltage dependent on a sum of the offsets of the plurality of offset amplifiers.

16 Claims, 5 Drawing Sheets

BANDGAP REFERENCE VOLTAGE CIRCUIT

FIELD

The disclosure relates to a bandgap reference voltage circuit, in which an output reference voltage is stable with respect to temperature and other variations.

BACKGROUND

Bandgap reference voltage circuits are widely used in integrated circuits where a fixed reference voltage is required that does not change with variations in power supply voltage, temperature and other factors. An example bandgap reference circuit 100 is illustrated in FIG. 1. The circuit 100 comprises a pair of PNP transistors 101*a*, 101*b* and three NPN transistors $Q_0$, $Q_1$, $Q_8$ between a supply voltage rail Vdd and a ground rail GND. NPN transistors $Q_0$, $Q_8$ are connected either side of a resistor 102 having a total resistance R+r. The resistance r is selected to bias NPN transistor $Q_1$ such that the output voltage Vbg is equal to Vbe+kΔVbe, where k is the ratio (R+r)/r and ΔVbe is the difference between the base to emitter voltages Vbe of NPN transistors $Q_1$, $Q_8$. Typically, the resistor ratio is close to 10. A problem with this type of circuit is that the resistor ratio may vary over time, resulting in a drift of the output voltage Vbg. If, for example, the ratio varies by 200 ppm the output voltage Vbg will typically vary by around 100 ppm. In some applications, for example in battery management systems, a lifetime drift limit may need to be less than 100 ppm, which may result in the circuit of this type being unsuitable. A problem therefore is how to manage the known drift in resistance of the resistors R, r, which are typically fabricated from polysilicon in integrated circuits, to maintain a smaller variation in output voltage with a lower drift over time. A further problem is that the circuit of the type in FIG. 1 requires multiple test insertions at different temperatures to trim the output voltage Vbg as a function of temperature, which adds substantial cost during manufacture.

SUMMARY

According to a first aspect there is provided a bandgap reference voltage circuit comprising an output voltage circuit and a plurality, n, of offset amplifiers connected between first and second voltage rails, the output voltage circuit comprising:

first, second and third PNP transistors;

an NPN transistor; and a resistor connected between collector connections of the first PNP transistor and the NPN transistor, wherein emitter connections of the first and second PNP transistors are connected together to a node, base connections of the first and second PNP transistors are connected together to a second sense connection on the resistor, a collector connection of the third PNP transistor and an emitter connection of the NPN transistor are connected to the second voltage rail, an emitter connection of the third PNP transistor is connected to a collector connection of the second PNP transistor, base connections of the NPN transistor and the third PNP transistor are connected together to a first sense connection on the resistor, wherein a first one of the plurality of offset amplifiers has an input connected to the emitter connection of the third PNP transistor, an nth one of the plurality of offset amplifiers having an output connected to the node, an output of each of the first to nth offset amplifiers connected to an input of a subsequent one of the plurality of offset amplifiers, each of the plurality of offset amplifiers comprising a differential pair of transistors that together define an offset between an input voltage at an input and an output of the amplifier.

The differential pair of transistors may differ in size by a factor m, which may be an integer greater than 2. The factor m may for example be an integer less than or equal to 10. In particular examples the factor m may be 8.

A position of the first and second sense connections along the resistor may be selectable to allows for adjustment of a resistance value between the sense connections. The first sense connection may for example be adjustable in increments that differ from the second sense connection, allowing for fine and course adjustments. Each sense connection may be connected to the resistor via a multiplexer, allowing the adjustments to be made according to a multibit value input to each multiplexer.

An output voltage Vbg at the second sense connection may be determined by $$V_{bg} = V_{be1} + \sum_{1}^{n} \Delta V_{be}$$

where $V_{be1}$ is a base-emitter voltage of the NPN transistor and $\Delta V_{be}$ is a difference between base-emitter voltages of the differential pair of transistors in each of the plurality of offset amplifiers.

According to a second aspect there is provided a method of adjusting an output voltage of the bandgap reference voltage circuit of the first aspect, the method comprising:

measuring an output bandgap voltage at the second sense connection; and adjusting a resistance value between the first and second sense connections to adjust the output bandgap voltage to a desired value.

These and other aspects of the invention will be apparent from, and elucidated with reference to, the embodiments described hereinafter.

BRIEF DESCRIPTION OF DRAWINGS

Embodiments will be described, by way of example only, with reference to the drawings, in which.

Figure 1:
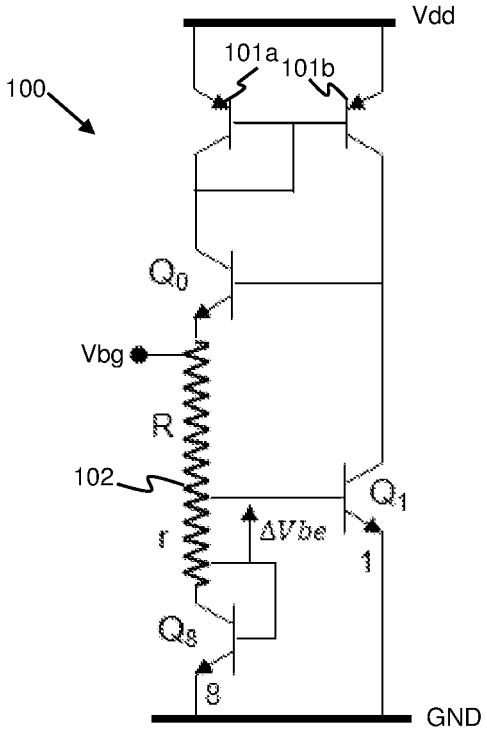
FIG. 1 is a schematic circuit diagram of an example conventional bandgap reference voltage circuit.

It should be noted that the Figures are diagrammatic and not drawn to scale. Relative dimensions and proportions of parts of these Figures have been shown exaggerated or reduced in size, for the sake of clarity and convenience in the drawings. The same reference signs are generally used to refer to corresponding or similar feature in modified and different embodiments.

DETAILED DESCRIPTION OF EMBODIMENTS

Figure 2:
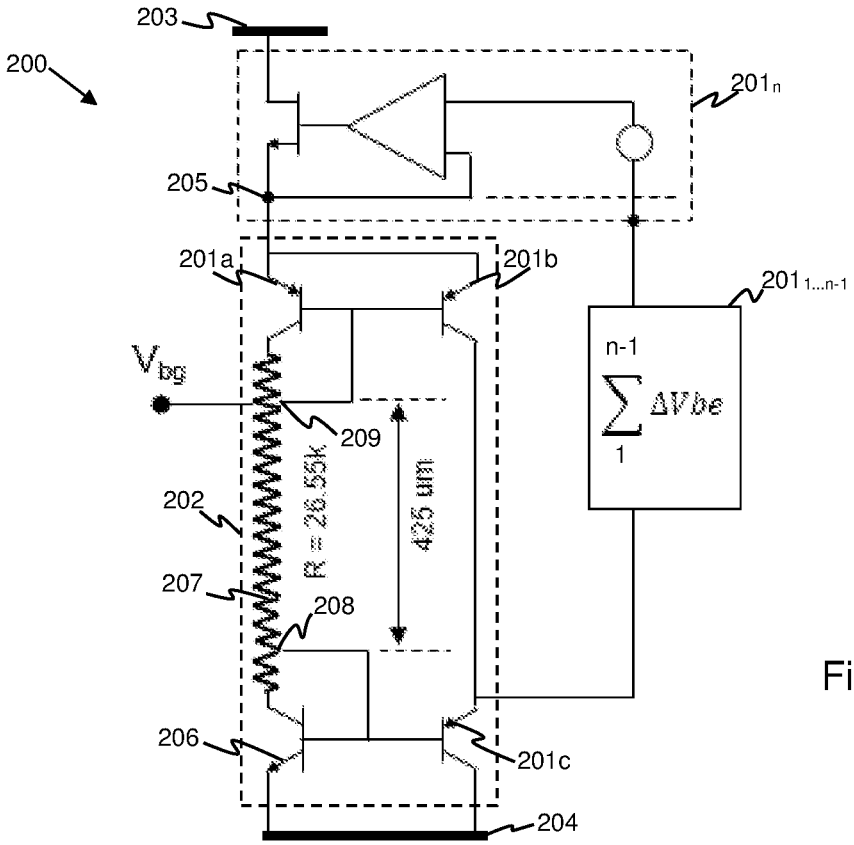
FIG. 2 is a schematic circuit diagram of an example bandgap reference voltage circuit.

FIG. 2 illustrates an example bandgap reference voltage circuit 200 in which, rather than being dependent on the k factor as in the conventional circuit shown in FIG. 1, the output voltage Vbg is derived from a sum of ΔVbe values from a plurality of cascaded offset amplifiers $\mathbf{201}_{1 \ldots n}$. The number, n, of cascaded offset amplifiers may vary depending on the reference voltage required and the value of ΔVbe in each amplifier. Each offset amplifier 201 may be of the form shown in FIG. 2, illustrated in more detail in FIG. 4, and with an example implementation illustrated in FIG. 5.

The bandgap reference voltage circuit 200 illustrated in FIG. 2 comprises a plurality of cascaded offset amplifiers $\mathbf{201}_{1 \ldots n}$ and an output voltage circuit 202 connected between a first, or supply, voltage rail 203 and a second, or ground, rail 204. The offset amplifiers $\mathbf{201}_{1 \ldots n}$ together provide current to the output voltage circuit 202 at a node 205 and define the voltage at the node 205. The output voltage circuit 202 is connected between the node 205 and ground 204. The output voltage circuit 202 comprises first, second and third PNP transistors 201*a*, 201*b*, 201*c*, an NPN transistor 206 and a resistor 207. Emitter connections of first and second PNP transistors 201*a*, 201*b* are connected to the node 205. Base connections of the first and second PNP transistors 201*a*, 201*b* are connected together. A collector connection of the third PNP transistor 201*c* is connected to ground 204 and an emitter connection of the third PNP transistor 201*c* is connected to a collector connection of the second PNP transistor 201*b*. An emitter connection of the NPN transistor 206 is connected to ground 204 and a base connection of the NPN transistor 206 is connected to a base connection of the third PNP transistor 201*c*. The base connections of the third PNP transistor 201*c* and the NPN transistor 206 are connected to a first, or bottom, sense connection 208 on the resistor 207. The resistor 207 is connected between collector connections of the first PNP transistor 201*a* and the NPN transistor 206. A second, or top, sense connection 209 is connected to the base connections of the first and second PNP transistors 201*a*, 201*b*. The second sense connection 209 provides an output voltage connection to provide the output bandgap voltage Vbg. In the example shown in FIG. 2, a resistance R between the first and second sense connections 208, 209 is 26.55 kΩ, which is provided by a 425 μm long section of a polysilicon resistor. The points at which the sense connections 208, 209 are made on the resistor 207 may be selectable to adjust the voltage output Vbg, as described in more detail below.

Figure 3:
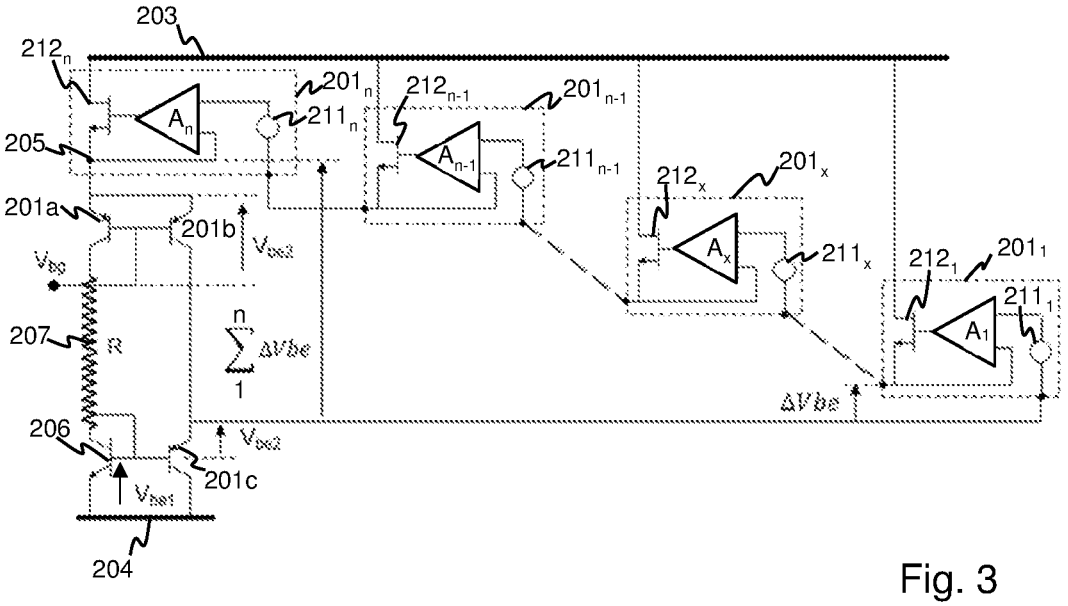
FIG. 3 is a schematic circuit diagram of the circuit of FIG. 2 in more detail.

The plurality of offset amplifiers $\mathbf{201}_{1 \ldots n}$ are connected between the emitter connection of the third PNP transistor 201*c* and the node 205, which is connected to the emitter connections of the first and second PNP transistors 201*a*, 201*b*. As shown in more detail in FIG. 3, a first offset amplifier $\mathbf{201}_1$ of the plurality of offset amplifiers $\mathbf{201}_{1 \ldots n}$ has an input connected to the emitter connection of the third PNP transistor 201*c*. The third PNP transistor 201*c* is required to provide a sufficiently high voltage at the input of the first offset amplifier $\mathbf{201}_1$ to drive the amplifier $\mathbf{201}_1$. An nth offset amplifier 201*n* has an output connected to the node 205. An output of each of the first to n−1 th offset amplifier $\mathbf{201}_{n-1}$ is connected to an input of a subsequent offset amplifier. The plurality of offset amplifiers $\mathbf{201}_{1 \ldots n}$ form a chain that provides an output voltage at the node 205 equal to the sum of base-emitter voltage differences $\Delta V_{be}$ from each of the offset amplifiers, i.e.

$$\sum_{1}^{n} \Delta V_{be},$$

plus the sum of the base-emitter voltages $V_{be1}$ and $V_{be2}$ from the NPN transistor and third PNP transistor 201*c*.

Figure 4:
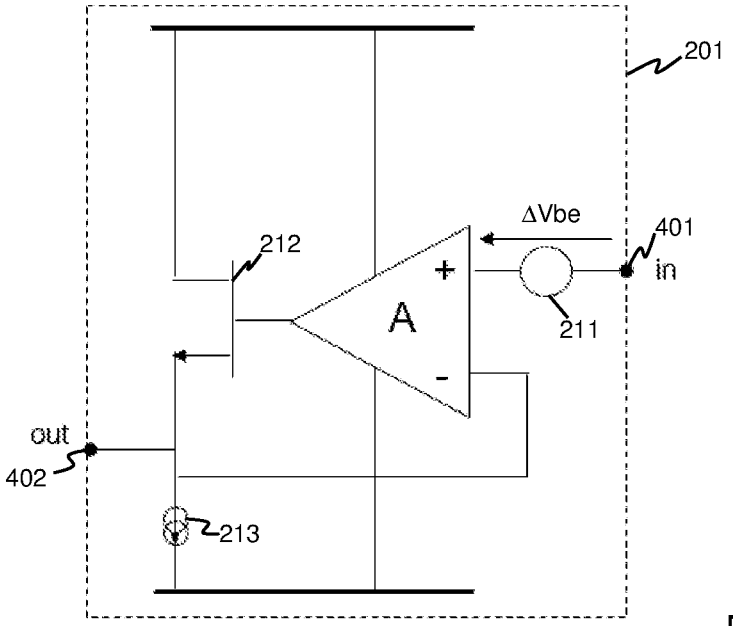
FIG. 4 is a schematic circuit diagram of an example bipolar amplifier for the circuit of FIG. 3.

As shown in FIG. 4, each offset amplifier 201 may be considered to comprise an ideal amplifier A, a voltage offset 211, an output switch 212 and current source 213. An input voltage at an input connection 401 of the offset amplifier 201 is offset by the voltage offset 211 and input to a non-inverting input of the amplifier A. An output of the amplifier A is provided to the switch 212, which provides an output voltage at an output connection 402. The voltage at the output connection 402 differs from the voltage at the input connection 401 by the offset provided by the voltage offset 211.

Referring again to FIG. 3, the chain of offset amplifiers $\mathbf{201}_{1 \ldots n}$ results in the output bandgap reference voltage Vbg being the sum of the base-emitter voltage $V_{be1}$ of the NPN transistor 206 (which is equal to the base-collector voltage of the third PNP transistor 201*c* due to their connected base connections), the base-emitter voltage $V_{be2}$ of the third PNP transistor 201*c*, the total of the n offset amplifiers $\mathbf{201}_{1 \ldots n}$ minus the base-emitter voltage $V_{be2}$ of the first and second PNP transistors 201*a*, 201*b*. The output bandgap voltage Vbg may therefore be expressed as:

$$V_{bg} = V_{be1} + V_{be2} - V_{be2} + \sum_{1}^{n} \Delta V_{be}$$

which reduces to:

$$V_{bg} = V_{be1} + \sum_{1}^{n} \Delta V_{be}$$

The bandgap reference voltage is therefore dependent primarily not on the k factor of the resistor 207 as in the prior bandgap reference voltage circuit of FIG. 1, but instead on a sum of voltage differences from the plurality of offset amplifiers $\mathbf{201}_{1 \ldots n}$. The effect of this is to reduce the dependence on variations in the resistor, making the output voltage more stable and less susceptible to drift.

Figure 5:
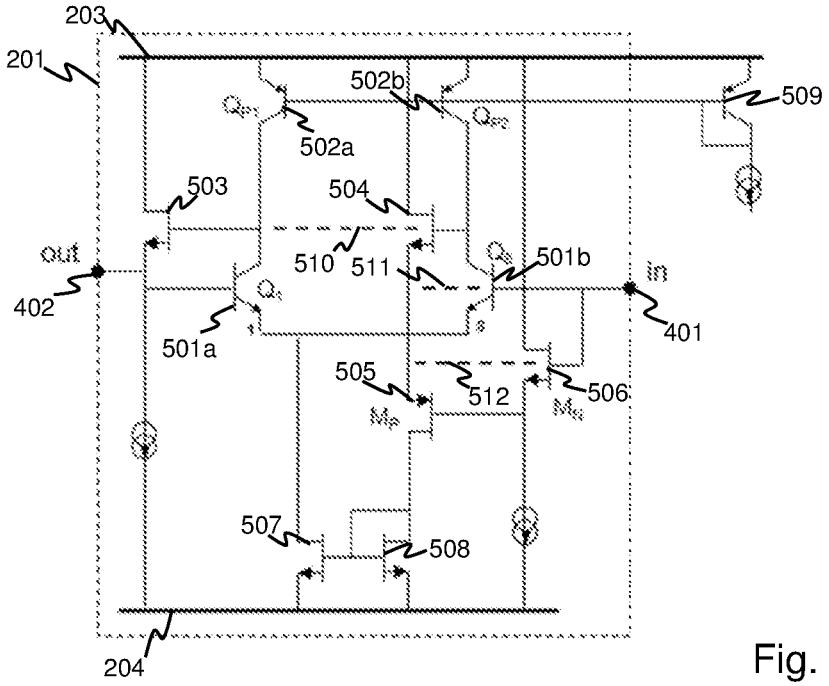
FIG. 5 is a schematic circuit diagram of an example implementation of the bipolar amplifier of FIG. 3.

An example practical implementation of the offset amplifier 201 is illustrated in FIG. 5. The amplifier 201 comprises a differential pair of NPN transistors 501*a*, 501*b* that together define an offset between the input voltage at the input 401 and the output 402. The circuit also comprises NFET transistors 503, 504, 506, 507, 508 and PFET transistor 505, a pair of PNP transistors 502*a*, 502*b* and a further PNP transistor 509, and is connected between a supply voltage rail 203 and a ground rail 204. The circuit 201 is configured to provide an output voltage at the output 402 that is offset from a voltage provided at the input 401 by a difference between the base-emitter voltages of the differential pair of transistors 501*a*, 501*b*, termed ΔVbe. Cascading such circuits allows for the voltage differences to be added.

Dotted lines 510, 511, 512 on the diagram in FIG. 5 indicate where voltage levels in the circuit are equal, i.e. at the input 401 and a connection between source connections of transistors 504, 505, and at collector connections of the pair of transistors 501*a*, 501*b*. It can be seen from this that the output voltage is thereby defined by the input voltage minus the Vbe of transistor 501*b* plus the Vbe of transistor 501*a*, thereby providing the required ΔVbe offset.

A tail current, i.e. the current pulled down by the drain of transistor 507, is controlled by a closed loop formed by transistors 504, 505, 512 and 507, which forces both collectors of the NPN transistor pair 501*a*, 501*b* to be at the same voltage, indicated by line 510. The tail current is driven by an NMOS mirror current, driven by PMOS transistor 505, which is driven by NMOS source follower 506 attached to the non-inverted input 401 by its gate. The source of transistor 505 is close to the same voltage as the input, indicated by line 512. The gate of transistor 504 is connected to the collector of transistor 501*b*. The follower stage transistor 506 provides a source voltage of Vin-Vgs, while the next follower stage transistor 505 will do the same, resulting in the source of transistor 505 being almost equal to Vin. The collectors of the differential pair 501*a*, 501*b* therefore have almost the same voltage. The collector of NPN transistor 501*a*, which corresponds to the output of amplifier A in FIG. 4, has a voltage equal to Vout+Vgs, where Vout is the voltage at the output 402 and Vgs is the gate to source voltage of transistor NFET 503 (corresponding to transistor 212 in FIG. 4).

The Δbe voltage offset between the input 401 and output 402 is determined by the difference in dimensions between transistors 501*a*, 501*b*, which is given by (kT/q)lnm, where k is the Boltzmann constant, T the absolute temperature and m the ratio in size between the pair of transistors 501*a*, 501*b*. Transistor 501*b* may for example be 8 times the size of transistor 501*a*. In a general aspect, the factor m may be an integer between 2 and 10. At room temperature kT/q equals 25 mV, so for m ranging from 2 to 10 the voltage offset will range from around 17 mV to around 57 mV. For a bandgap reference voltage m may be chosen to be 8 because this is a good compromise between the silicon area and k factor. A lower value of M will require a higher k factor, while a higher value will require the size of the larger transistor 501*b* to increase.

Figure 6:
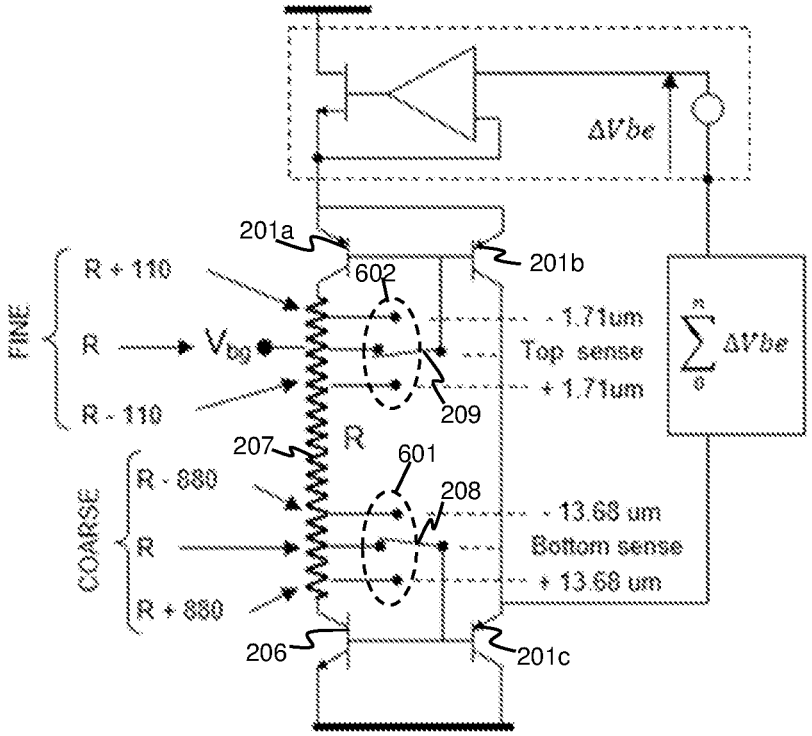
FIG. 6 is a schematic circuit diagram of a further example bandgap reference voltage circuit.

Given that the difference in size between the transistors will in practice be incremental, the value of m alone is not sufficient to accurately define the required bandgap reference voltage. A solution to this is to allow for the resistance between the sense connections 208, 209 (see FIG. 2) to be adjusted. A schematic diagram illustrating this is shown in FIG. 6, in which first and second sense connections 208, 209 are each selectable between multiple locations 601, 602 along the resistance 207. This may be implemented using a multiplexer for each sense connection 208, 209, thereby allowing for adjustment of the resistance value between the base connections of transistors 201*a*, 201*b* and transistors 206, 201*c*. Example values are shown in FIG. 6 of how much each sense connection 208, 209 may be trimmed. For the second, or top, sense connection 209 the trimming may involve steps of around 1.71 μm along the resistor 207, while for the first, or bottom, sense connection 208 may involve larger steps of around 13.68 μm. In a general aspect, the sense connections 208, 209 may be adjustable along the resistor 207 by increments. The increments for the first sense connection may differ from the increments for the second sense connection. Providing differing increments enables coarse and fine adjustments to be made to the resistance value between the sense connections 208, 209. Using a multiplexer for each sense connection, if three bits are used for each connection a total of eight different connection points may be selectable for each sense connection, enabling the resistance value to be selected to finely tune the output voltage Vbg. In the example shown in FIG. 6, the coarse adjustments enable changes of +/−880Ω while fine adjustments enable changes of +/−110Ω.

Figure 9:
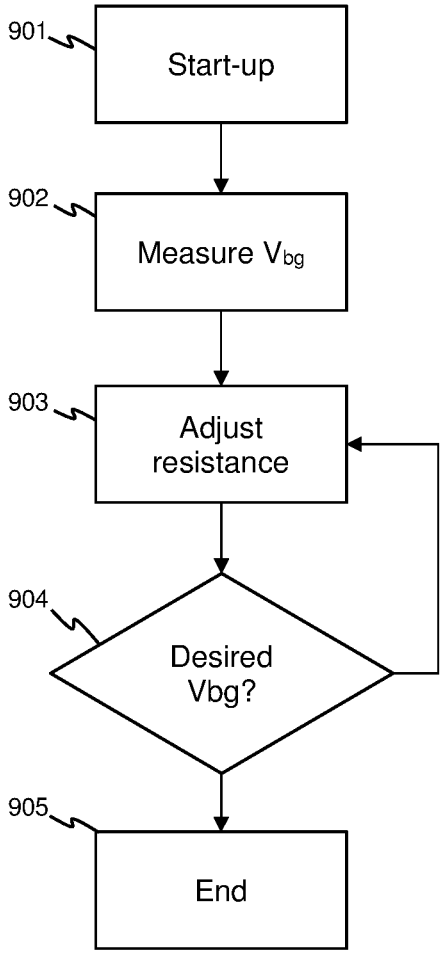
FIG. 9 is a flow diagram illustrating an example method of adjusting an output voltage of the bandgap reference voltage circuit.

FIG. 9 illustrates a flow diagram showing a method of adjusting an output bandgap reference voltage for a circuit as described herein. After starting up the circuit (step 901), at step 902 the output voltage Vbg is measured. The resistance is then adjusted (step 903) and a measurement taken to determine whether Vbg has reached a desired value (step 904). If not, the resistance is adjusted again. Once the desired Vbg has been reached, the process ends (step 905) and the circuit is calibrated for use. The adjustment may be stored, for example by storing a series of bits that define the positions of the sense connections 208, 209.

Figure 7:
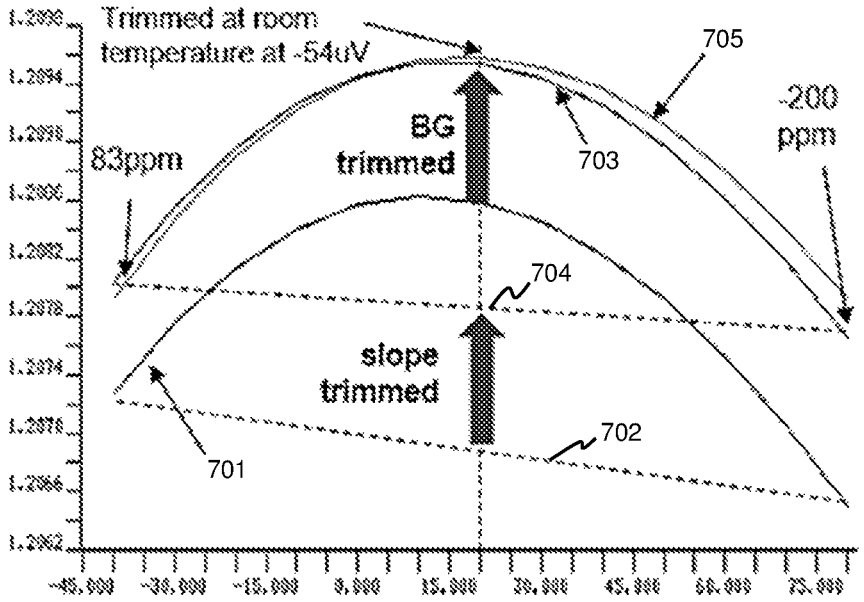
FIG. 7 is a plot of bandgap voltage as a function of temperature for a trimmed and untrimmed circuit.

An advantage of the circuit arrangement, where base connections of transistors 206, 201*c* are connected together with the first sense connection and base connections of transistors 201*a*, 201*b* are connected together with the second sense connection, is that trimming the resistance between the first and second sense connections 208, 209 trims both the absolute value of Vbg as well as the slope of Vbg with respect to temperature. An example illustrating this is shown in FIG. 7, which plots Vbg (in Volts) as a function of temperature (in ° C.). An untrimmed relationship of Vbg versus temperature 701 has a slope 702, while a trimmed relationship 703 has a reduced slope 704. The trimmed relationship 703 as a result more closely matches a typical required curve 705. A comparison between the typical curve 705 and the trimmed curve 703 results in a difference of 83 ppm at −40° C. and 200 ppm at 80° C. This is achieved using only one trimming operation, rather than the conventional technique of performing multiple measurements at two or three different temperatures before trimming.

An advantage of the circuit disclosed herein is that variation in the resistor 207 has much less effect on the output voltage Vbg than in a conventional bandgap voltage reference circuit. To take an example of a conventional circuit with a resistor of 30 kΩ, if the k factor varies by 200 ppm, equivalent to a 6Ω difference, the bandgap voltage will move by around 100 ppm. By comparison, using the circuit described herein, a resistance variation of 1000 ppm, i.e. five times more than the above mentioned variation, results in the output bandgap voltage varying by only 25 ppm, four times less. Overall therefore, the variation in the output voltage is around 20 times less than for the conventional circuit. This allows the circuit to be used in applications where a lower drift in the output voltage is required, such as in battery management systems for lithium ion batteries.

Figure 8:
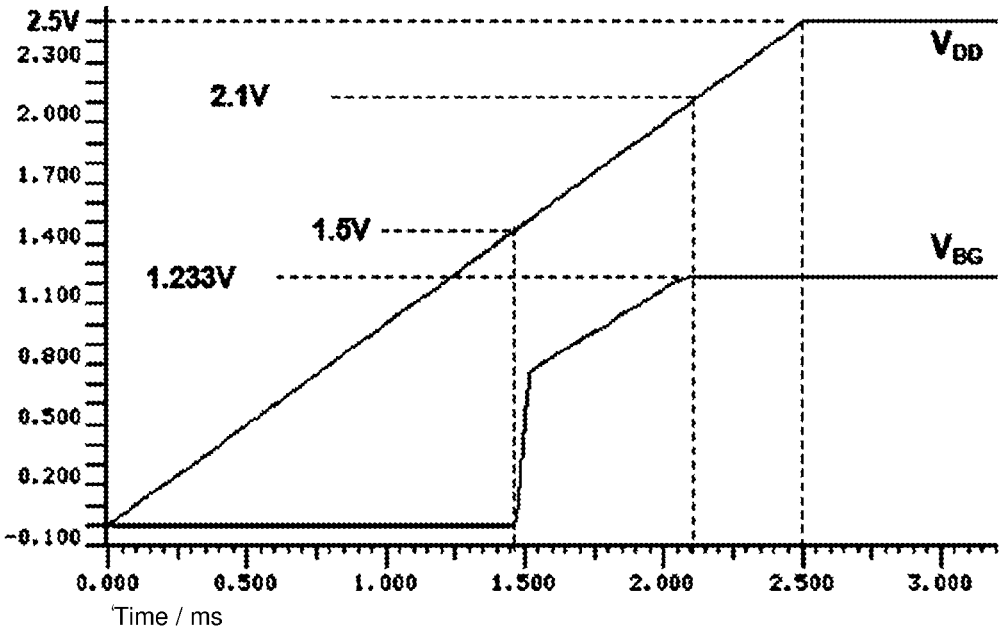
FIG. 8 is a plot of voltage as a function of time during start-up of the circuit of FIG. 2.

A further advantage is that no start-up circuit is required because the output is not dependent on a k multiplication factor. This output of the circuit is instead the sum and difference of the various Vbe values across the bias resistor 207. As illustrated in FIG. 8, which plots voltage as a function of time, as the supply voltage $V_{DD}$ rises, the bandgap voltage VBG rises to the required value, in this case 1.233V, once the supply voltage has reached 2.1V within around 2.1 ms. Above this, the bandgap voltage remains constant.

In summary, the circuit described herein allows for a sum of $\Delta V_{be}$ to be used instead of the multiplication of the $\Delta V_{be}$ by a k factor. Each $\Delta V_{be}$ is provided by a built-in offset amplifier configured in follower mode with a unity gain closed loop configuration. Because of smaller parameter variation (with no k factor), this provides for a reduced bandgap value drift as well as a correlation between bandgap value and slope, allowing for a single test insertion to trim the bandgap during manufacture and testing.

From reading the present disclosure, other variations and modifications will be apparent to the skilled person. Such variations and modifications may involve equivalent and other features which are already known in the art of bandgap reference voltage circuits, and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable sub-combination. The applicant hereby gives notice that new claims may be formulated to such features and/or combinations of such features during the prosecution of the present application or of any further application derived therefrom.

For the sake of completeness it is also stated that the term "comprising" does not exclude other elements or steps, the term "a" or "an" does not exclude a plurality, a single processor or other unit may fulfil the functions of several means recited in the claims and reference signs in the claims shall not be construed as limiting the scope of the claims.

What is claimed is:

1. A bandgap reference voltage circuit comprising an output voltage circuit and a plurality, n, of offset amplifiers connected between first and second voltage rails, the output voltage circuit comprising:

first, second and third PNP transistors;

an NPN transistor; and a resistor connected between collector connections of the first PNP transistor and the NPN transistor, wherein emitter connections of the first and second PNP transistors are connected together to a node, base connections of the first and second PNP transistors are connected together to a second sense connection on the resistor, a collector connection of the third PNP transistor and an emitter connection of the NPN transistor are connected to the second voltage rail, an emitter connection of the third PNP transistor is connected to a collector connection of the second PNP transistor, base connections of the NPN transistor and the third PNP transistor are connected together to a first sense connection on the resistor, wherein a first one of the plurality of offset amplifiers has an input connected to the emitter connection of the third PNP transistor, an nth one of the plurality of offset amplifiers having an output connected to the node, an output of each of the first to nth offset amplifiers connected to an input of a subsequent one of the plurality of offset amplifiers, each of the plurality of offset amplifiers comprising a differential pair of transistors that together define an offset between an input voltage at an input and an output of the amplifier.

2. The bandgap reference voltage circuit of claim 1, wherein the differential pair of transistors differ in size by a factor m.

3. The bandgap reference voltage circuit of claim 1, wherein the factor m is an integer greater than 2.

4. The bandgap reference voltage circuit of claim 1, wherein the factor m is an integer less than or equal to 10.

5. The bandgap reference voltage circuit of claim 1, wherein a position of the first and second sense connections along the resistor are selectable to allows for adjustment of a resistance value between the sense connections.

6. The bandgap reference voltage circuit of claim 5, wherein the first sense connection is adjustable in increments that differ from the second sense connection.

7. The bandgap reference voltage circuit of claim 5, wherein each sense connection is connected to the resistor via a multiplexer.

8. The bandgap reference voltage circuit of claim 1, wherein an output voltage Vbg at the second sense connection is determined by $$V_{bg} = V_{be1} + \sum_{1}^{n} \Delta V_{be}$$

where $V_{be1}$ is a base-emitter voltage of the NPN transistor and $DV_{be}$ is a difference between base-emitter voltages of the differential pair of transistors in each of the plurality of offset amplifiers.

9. A method of adjusting an output voltage of the bandgap reference voltage circuit, the bandgap reference voltage circuit comprising an output voltage circuit and a plurality, n, of offset amplifiers connected between first and second voltage rails, the output voltage circuit comprising:

first, second and third PNP transistors;

an NPN transistor; and a resistor connected between collector connections of the first PNP transistor and the NPN transistor, wherein emitter connections of the first and second PNP transistors are connected together to a node, base connections of the first and second PNP transistors are connected together to a second sense connection on the resistor, a collector connection of the third PNP transistor and an emitter connection of the NPN transistor are connected to the second voltage rail, an emitter connection of the third PNP transistor is connected to a collector connection of the second PNP transistor, base connections of the NPN transistor and the third PNP transistor are connected together to a first sense connection on the resistor, wherein a first one of the plurality of offset amplifiers has an input connected to the emitter connection of the third PNP transistor, an nth one of the plurality of offset amplifiers having an output connected to the node, an output of each of the first to nth offset amplifiers connected to an input of a subsequent one of the plurality of offset amplifiers, each of the plurality of offset amplifiers comprising a differential pair of transistors that together define an offset between an input voltage at an input and an output of the amplifier, the method comprising:

measuring an output bandgap voltage at the second sense connection; and adjusting a resistance value between the first and second sense connections to adjust the output bandgap voltage to a desired value.

10. The method of claim 9, wherein the differential pair of transistors differ in size by a factor m.

11. The method of claim 9, wherein the factor m is an integer greater than 2.

12. The method of claim 9, wherein the factor m is an integer less than or equal to 10.

13. The method of claim 9, wherein the resistance value between the first and second sense connections is adjusted by adjusting a selected position of the first and second sense connections along the resistor.

14. The method of claim 13, wherein the first sense connection is adjustable in increments that differ from the second sense connection.

15. The method of claim 13, wherein each sense connection is connected to the resistor via a multiplexer.

16. The method of claim 9, wherein an output voltage Vbg at the second sense connection is determined by $$V_{bg} = V_{be1} + \sum_{1}^{n} \Delta V_{be}$$

where $V_{be1}$ is a base-emitter voltage of the NPN transistor and $DV_{be}$ is a difference between base-emitter voltages of the differential pair of transistors in each of the plurality of offset amplifiers.

* * * * *